US007789007B2

(12) United States Patent
Bosman

(10) Patent No.: US 7,789,007 B2
(45) **Date of Patent: *Sep. 7, 2010**

(54) BRAIDED ROPE CONSTRUCTION

(75) Inventor: Rigobert R. Bosman, Landgraaf (NL)

(73) Assignee: DSM IP Assets B.V., Heerlen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 12/490,131

(22) Filed: Jun. 23, 2009

(65) Prior Publication Data

US 2009/0260510 A1 Oct. 22, 2009

Related U.S. Application Data

(63) Continuation of application No. 11/921,672, filed as application No. PCT/EP2006/005619 on Jun. 12, 2006, now Pat. No. 7,568,419.

(30) Foreign Application Priority Data

Jun. 13, 2005 (EP) ..... 05076377

(51) Int. Cl.
*D04C 1/06* (2006.01)

(52) U.S. Cl. ..... 87/8; 87/13

(58) Field of Classification Search ..... 87/8, 87/9, 11, 13

See application file for complete search history.

(56) References Cited

U.S. PATENT DOCUMENTS

| | | | | |
|---|---|---|---|---|
| 3,451,305 | A | 6/1969 | Johnson et al. | |
| 5,860,350 | A | 1/1999 | Rexroad | |
| 5,901,632 | A | 5/1999 | Ryan | |
| 6,386,484 | B1 | 5/2002 | Hoyt et al. | |
| 6,431,497 | B1 | 8/2002 | Hoyt et al. | |
| 7,568,419 | B2 * | 8/2009 | Bosman | 87/8 |

FOREIGN PATENT DOCUMENTS

| | | | |
|---|---|---|---|
| DE | 30 35 214 | A1 | 4/1982 |
| DE | 31 29 857 | A1 | 2/1983 |
| EP | 0 083 966 | | 7/1983 |
| WO | WO 2005/019525 | A1 | 3/2005 |

OTHER PUBLICATIONS http://www.steinlaufandstoller.com/Braid.htm (Apr. 5, 2003).*
International Search Report mailed Dec. 12, 2006, in PCT/EP2006/005619.
Written Report mailed Dec. 12, 2006 in PCT/EP2006/005619.

* cited by examiner

*Primary Examiner*—Shaun R Hurley
(74) *Attorney, Agent, or Firm*—Nixon & Vanderhye P.C.

(57) ABSTRACT

The invention relates to a braided rope for bend-over-sheave applications consisting essentially of n braided primary strands being made of polymeric filaments, which rope has an oblong cross-section with aspect ratio in the range 1.2-4.0. Such a rope shows markedly improved service life performance in cyclic bend-over-sheave applications. The invention also relates to the use of a braided rope according to the invention as a load-bearing member in bend-over-sheave applications; and to a system comprising such a rope and at least one sheave with a groove, the dimensions of which groove are adapted to the rope dimensions.

11 Claims, No Drawings

BRAIDED ROPE CONSTRUCTION

This application is a continuation of commonly owned U.S. application Ser. No. 11/921,672, filed Dec. 6, 2007 now U.S. Pat. No. 7,568,419), which in turn is the national phase application under 35 USC §371 of PCT/EP2006/005619, filed Jun. 12, 2006, which designated the U.S. and claims benefit of EP 05076377.0, filed Jun. 13, 2005, the entire content of each being hereby incorporated by reference herein.

The invention relates to a braided rope for bend-over-sheave applications consisting essentially of braided primary strands, the amount of strands relates to a system comprising said rope and a sheave, and to a method for making the rope according to the invention.

Such rope construction is known from U.S. Pat. No. 5,901,632. In this patent publication a large-diameter braided rope is described, which rope contains primary strands that themselves have been braided, preferably from rope yarns containing high-strength polymeric filaments. In the most preferred embodiments indicated, the rope is a 12-strand, two-over/two-under circular braid, wherein each strand is itself a 12-strand braid made from high-modulus polyethylene (HMPE filaments (12×12 construction).

Braided ropes for bend-over-sheave applications are within the context of the present application considered to be load-bearing ropes typically used in lifting and mooring applications; such as marine, oceanographic, offshore oil and gas, seismic, commercial fishing and other industrial markets. During such uses, together referred to as bend over-sheave applications, the rope is frequently pulled over drums, bitts, pulleys, sheaves, etc., a.o. resulting in rubbing and bending. When exposed to such frequent bending or flexing, a rope may fail due to rope and filament damage resulting from e.g. external and internal abrasion, frictional heat, or fatigue failure; also referred to as bending fatigue or flex fatigue, To reduce flex fatigue of a rope in bend-over-sheave applications, use of a sheave (or other surface) with a diameter of at least 8 times the rope diameter is generally advised. In order to reduce loss of strength in a rope resulting from external abrasion, it is known to provide a jacket, for example a woven or braided sleeve, to the rope or to the strands in the rope. These jackets, however, increase rope diameter and stiffness, and add weight and cost, but do not contribute to the load bearing capacity of the rope; and visual inspection of the load bearing elements is not possible. Applying a specific mixture of polymeric filaments in the rope strands is proposed in US 2004/0069132 A1. Other known measures to improve performance include providing specific finishes or coatings to the rope.

A drawback of known rope constructions, however, remains a limited service life when exposed to frequent bending or flexing. Accordingly, there is a need in industry for ropes that show improved performance in cyclic bend-over-sheave applications during prolonged times. The object of the invention is therefore to provide such a braided rope showing improved performance.

This object is achieved according to the invention with a braided rope that has an oblong cross-section with aspect ratio in the range 1.2-4.0.

It is surprising that the large diameter braided rope according to the invention shows improved service life performance in cyclic bend-over-sheave applications, because for rope making generally circular or tubular braids with a virtually round cross-section are used; see for example at p. 203 ff of the Handbook of fibre rope technology (eds McKenna, Hearle and O'Hear, Woodhead Publishing Ltd, ISBN 1 85573 606 3).

Ropes or cords with a flattened cross-section per se are known, for example flat braids, or so-called soutache braids; but such braided structures are commonly applied as ornaments, decorations, or candle wicking, and not for load-bearing ropes such as deep-sea installation ropes.

Other advantages of the rope according to the invention include that less heat, for example as a result of inter strand and/or inter filament friction, is generated during use; and that the rope has an open structure, resulting in more efficiently cooling by e.g. water. The rope has high strength efficiency, meaning the strength of the rope is a relatively high percentage of the strength of its constituting filaments. The rope also shows improved performance on traction and storage winches; i.e. more regular winding and less burying-in. The rope according to the invention can be easily inspected on possible damage, and can be readily, if needed, repaired.

The present invention therefore also relates to the use of a braided rope of construction and composition as further detailed in this application as a load-bearing member in bend-over-sheave applications.

In the rope according to the invention the primary strands, also referred to as strands, themselves are braided, torque-balanced constructions, in stead of laid or parallel rope strands to result in balanced and torque-free rope, even when consisting of an uneven number of strands. The number of primary strands (n) in a braided rope is 3 or more.

The rope according to the invention has an oblong cross-section, meaning that the cross-section of a tensioned rope shows not a circular, round or cubic form as common for heavy-duty ropes, but rather a flattened, oval, or even (depending on the number of primary strands) an almost rectangular form. The cross-section has an aspect ratio, i.e. the ratio of the larger to the smaller diameter (or width to height ratio), in the range of from 1.2 to 4.0. Methods to determine the aspect ratio are known to the skilled person; an example includes measuring the outside dimensions of the rope, while keeping the rope under (at least a small) tension, or after tightly winding an adhesive tape around it. The advantage of said aspect ratio is that during cyclic bending less stress differences occur between the filaments in the rope, and less abrasion and frictional heat occurs, resulting in enhanced bending fatigue life. An aspect ratio greater than about 4, resulting from certain braid constructions, however, results in reduced strength of the rope, or better, in lower strength efficiency. Therefore, the cross-section has preferably an aspect ratio of about 1.3-3.0, more preferably about 1.4-2.0; even more preferably about 1.5-1.8, and most preferably about 1.6-1.7.

The rope according to the invention can be of various braid constructions. There is a variety of types of braids known, each generally distinguished by the method that forms the fabric. Suitable constructions include soutache braids, tubular braids, and flat braids. The soutache braid is a flat fabric which can be easily deformed; and is commonly used for wicking, ornamental fabrics, embroidery and trimmings. The soutache braid can be made with a braiding machine having two horngears/horndogs, each having an odd number of slots typically designed for 3-17 carriers (and thus 3-17 primary strands). Tubular or circular braids are the most common braids and generally consist of two sets of strands that are intertwined, with different patterns possible. A tubular braid can for example be made on a machine comprising a series of horngears/horndogs in circular array, wherein the two sets of strands are moved in a circle in opposite directions to each other, while the strands are moved in and out the radial direction (Maypole braider). The number of strands in a tubular braid may vary widely. Especially if the number of strands is high, and/or if the strands are relatively thin, the tubular braid may have a hollow core; and the braid may collapse into an oblong shape. A flat braid can be viewed as a modification of the tubular braid, and can be made with a braiding machine wherein the horngears do not form a closed circle (1 or more adjacently missing). In this way, the carriers with strands reach an end of the cycle and are then passed back in reversed orientation.

The number of primary strands in the rope according to the invention is at least 3. An increasing number of strands results in a higher aspect ratio of the cross-section of the rope. A higher number of strands, however, tends to lower the strength efficiency of the rope. The number of strands is therefore preferably at most 16, depending on the type of braid. Particularly suitable are ropes wherein the number of strands n is 3-12. Preferably, the rope is a soutache braid, and n is 3, 5, 7, or 9; more preferably 5 or 7. Such ropes provide a favourable combination of tenacity and resistance to flex fatigue, and can be made economically on relatively simple machines.

The braided rope according to the invention can be of a construction wherein the braiding period (that is the pitch length related to the width of the rope) is not specifically critical; suitable braiding periods are in the range of from 4 to 20. A higher braiding period results in a more loose rope having higher strength efficiency, but which is less robust and more difficult to splice. Too low a braiding period would reduce tenacity too much. Preferably therefore, the braiding period is about 5-15, more preferably 6-10.

The rope according to the invention can have a diameter that varies between wide limits. Smaller diameter ropes, for example in the range of from about 2 to 20 mm, are typically applied as cords in mechanical devices; such as an automotive door window lifting mechanism. Large diameter, or heavy-duty ropes typically have a diameter of at least 20 mm. In case of a rope with an oblong cross-section, it is more accurate to define the size of a round rope by an equivalent diameter; that is the diameter of a round rope of same mass per length as the non-round rope. The diameter of a rope in general, however, is an uncertain parameter for measuring its size, because of irregular boundaries of ropes defined by the strands. A more concise size parameter is the linear density of a rope, also called titer; which is the mass per unit length. The titer can be expressed in kg/m, but often the textile units denier (g/9000 m) or dtex (g/10000 m) are used. Diameter and titer are interrelated according to the formula $d=(T/(10*\rho*v))^{0.5}$, wherein T is the titer (dtex), d is the diameter (mm), ρ is the density of the filaments (kg/m$^3$), and v is a packing factor (normally between about 0.7 and 0.9). Nevertheless, it is still customary in the rope business to express rope size in diameter values. Preferably, the rope according to the invention is a heavy-duty rope having an equivalent diameter of at least 30 mm, more preferably at least 40, 50, 60, or even at least 70 mm, since the advantages of the invention become more relevant the larger the rope. Largest ropes known have diameters up to about 300 mm, ropes used in deepwater installations typically have a diameter of up to about 130 mm.

In the rope according to the invention each primary strand is itself a braided rope. Preferably, the primary strands are circular braids made from an even number of secondary strands, also called rope yarns. The number of secondary strands is not limited, and may for example range from 6 to 32; with 8, 12 or 16 being preferred in view available machinery for making such braids. The skilled man in the art can choose the type of construction and titer of the strands in relation to the desired final construction and size of the rope, based on his knowledge or with help of some calculations or experimentation.

The secondary strands or rope yarns containing polymeric filaments can be of various constructions, again depending on the desired rope. Suitable constructions include twisted multi-filament yarns (or laid ropes); but also braided ropes or cords, like a circular braid, can be used. Suitable constructions are for example mentioned in U.S. Pat. No. 5,901,632.

The rope yarns can contain a variety of polymeric filaments, either in the form of monofilaments (typically of diameter up to the mm range) or of multi-filament yarns, containing filaments having a titer typically in the 0.2-25 dtex range, preferably about 0.5-20 dtex. Suitable filaments are made from synthetic polymers; including polyolefins like polypropylenes and polyethylenes (including copolymers and ultra-high molar mass polymers), polyesters (including poly(ethyleneterephthalate), or thermotropic polyesters), polyamides (including PA 6, PA 66 or PA46, or lyotropic aromatic polyamides). The rope yarns may contain only one type of filament, but also blends of one or more different filaments, e.g. with complementary properties. Preferably, the rope yarns contain high-strength filaments, having a tenacity of at least 1.5, more preferably at least 2.0, 2.5 or even at least 3.0 N/tex. Tensile strength, also simply strength, or tenacity of filaments are determined by known methods, as based on ASTM D885-85 or D2256-97. Generally such high-strength polymeric filaments also have a high tensile modulus, e.g. at least 50 N/tex, preferably at least 75, 100 or even at least 125 N/tex. The advantage of using such high-strength and/or high-modulus filaments is that the resulting rope also has high tenacity; that is its diameter can be relatively small relative to a standard rope containing lower strength filaments and having the same maximum load-bearing capacity.

In a preferred embodiment, the polymeric filaments in the rope according to the invention comprise high-strength filaments made from ultra-high molar mass polyethylene, also referred to as high-modulus polyethylene filaments (HMPE), and optionally other filaments. More preferably, the primary strands consist essentially of HMPE filaments; the advantage being that these filaments combine properties like a high tensile strength, good abrasion resistance and a low specific weight, resulting in a high-strength rope that can have a density of smaller than 1; and which rope will float on water.

Ultra-high molar mass polyethylene (UHPE) has an intrinsic viscosity (IV) of more than 4 dl/g. The IV is determined according to method PTC-179 (Hercules Inc. Rev. Apr. 29, 1982) at 135° C. in decalin, the dissolution time being 16 hours, with DBPC as anti-oxidant in an amount of 2 μl solution, and the viscosity at different concentrations is extrapolated to zero concentration. Intrinsic viscosity is a measure for molar mass (also called molecular weight) that can more easily be determined than actual molar mass parameters like $M_n$ and $M_w$. There are several empirical relations between IV and $M_w$, for example $M_w=5.37\times10^4\,[IV]^{1.37}$ (see EP 0504954 A1), but such relation is dependent on molar mass distribution. HMPE fibres, e.g. filament yarn, can be prepared by spinning of a solution of UHPE in a suitable solvent into a gel fibre and drawing the fibre before, during and/or after partial or complete removal of the solvent; that is via a so-called gel-spinning process as for example described in EP 0205960 A, in WO 01/73173 A1, in Advanced fiber spinning technology, Ed. T. Nakajima, Woodhead Publ. Ltd (1994), ISBN 185573 182 7, and in references cited therein. The HMPE fibres preferably have an IV of between about 5 and 40 dl/g, more preferably between 7 and 30 dl/g. Preferably, the UHPE is a linear polyethylene with less than one branch per 100 carbon atoms, and preferably less than one branch per 300 carbon atoms, a branch or side chain usually containing at least 10 carbon atoms. The linear polyethylene may further contain up to 5 mol % of one or more comonomers, such as alkenes like propylene, butene, pentene, 4-methylpentene or octene.

In a preferred embodiment, the UHPE contains a small amount of relatively small groups as side chains, preferably a C1-C4 alkyl group. It is found that a certain amount of such groups results in fibres having improved creep behaviour. Too large a side chain, or too high an amount of side chains, however, negatively affects the processing and especially the drawing behaviour of the filaments. For this reason, the UHPE preferably contains methyl or ethyl side chains, more preferably methyl side chains. The amount of such side chains is preferably at most 20, more preferably at most 10 per 1000 carbon atoms.

The HMPE fibres applied in the rope according to the invention may further contain small amounts, generally less than 5 mass %, preferably less than 3 mass % of customary additives, such as anti-oxidants, thermal stabilizers, colorants, flow promoters, etc. The UHPE can be a single polymer grade, but also a mixture of two or more different polyethylene grades, e.g. differing in IV or molar mass distribution, and/or type and number of comonomers or side chains.

In a special embodiment of the invention, the braided rope is post-stretched, or its primary strands comprising HMPE filaments are post-stretched, preferably at a temperature in the range 100-120° C., to further increase the strength of the rope. Such a post-stretching step is described in a.o. EP 0398843 B1 or U.S. Pat. No. 5,901,632.

The rope according to the invention consisting essentially of primary strands means that the primary strands are the main constituents, giving the rope is load-bearing properties. Thus the amount of the primary strands in the rope is equal to n. The rope may further comprise auxiliary components to further enhance performance or give it some additional properties, as would be known to a skilled person. Examples include some auxiliary rope strand or yarn with e.g. electrically conductive or light transmitting characteristics, a change in which property may serve for example as an indicator for an overload situation having occurred. The rope can also further comprise any customary coating or sizing, which coating may protect the rope or act as lubricant to enhance resistance to abrasion. Coating materials suitable or such purpose are generally applied as aqueous dispersions, for example of thermoplastic polymers or bituminous compounds.

A further advantage of the rope according to the invention is that the primary strands can contain splices as end-to-end connections between two segments of strands. Such a rope can have a length exceeding that of the length of a strand on a carrier, virtually without reduction in strength. The rope may contain any known braided rope splice in one or more strands.

Very good performance was obtained with a 5-strand 1 over 2, 1 under 2 braided rope construction having an equivalent diameter of at least 20 mm, consisting essentially of braided strands made of high-performance polyethylene filaments having a tenacity of at least 2.5 N/tex.

The invention also relates to a system comprising a rope according to the invention and at least one sheave, preferably with a groove, the dimensions of which groove are adapted to the rope dimensions. Present sheaves for use with round ropes generally have a rounded groove, with a diameter that is preferably at least 10% greater than the diameter of the rope. The dimensions of the sheave groove being adapted to the rope dimensions means that the sheave for use in combination with the rope according to the invention has a groove of a form similar to the cross-sectional form of that roper and of a width at least 10% greater than the width of the oblong rope, in order to prevent damaging of the rope through excessive friction and compression. The sheave preferably has a diameter that is at least about 8 times the equivalent diameter of the rope. The system may further comprise any other components, as known to a person skilled in the art.

The rope according to the invention can be made with known braiding techniques, as discussed above.

A preferred method for making a rope according to the invention comprises a step of braiding n primary strands from n carriers using two counter-rotating horngears/horndogs each having n notches (or slots) for transferring the carriers in a single figure eight track, with n being an odd integer of 3 or more. Such method is referred to as soutache braiding in the art. Preferably, the number of strands n is 3, 5, 7, or 9; more preferably 5 or 7, to arrive at a rope with a favourable combination of properties. In case of a 5-strand soutache braid, the rope is preferably made with a 1 over 2, 1 under 2 braiding construction.

In a further embodiment the method according to the invention comprises flat braiding 4 to 16 primary strands, preferably 6-12 strands.

Further preferred embodiments for the braiding method, and for the construction and composition of the rope and its primary strands are analogous to those discussed above for the rope.

The method according to the invention may further comprise a step of splicing the end of one primary strand to an end of a next primary strand, when the carrier containing the strand runs empty. This way the length of the rope can be extended to any desired length, without the resulting rope containing weak spots that would lead to lower breaking strength.

The method according to the invention may also further comprise a step of post-stretching the primary strands before the braiding step, or alternatively a step of post-stretching the braided rope. Such is stretching step is preferably performed at elevated temperature but below the melting point of the (lowest melting) filaments in the stands (=heat-stretching), For a rope containing HMPE filaments a preferred temperature lies in the range 100-120° C. Such a post-stretching step is described in a.o. EP 398843 B1 or U.S. Pat. No. 5,901,632.

The invention will be elucidated with reference to the following experiments.

EXAMPLE 1

A 5-strand braided rope was made from Dyneema® SK75 1760 dtex multi-filament yarn, made from ultra-high molar mass polyethylene and having tenacity of about 3.4 N/tex and modulus of about 120 N/tex (available from DSM Dyneema BV, NL). First 12-strand torque-balanced braided ropes were made from twined rope yarns consisting of (3×7)×1760 dtex SK75 yarns. Five of these braided strands having a diameter of about 11 mm were subsequently braided in a 1 over 2, 1 under 2 construction into a rope with an oblong cross-section of dimensions (at 10 ton loading) of about 26.4 mm width and about 16.8 mm height, having a pitch length (braiding period) of about 6.4 times the width of the rope. The rope was coated with coating composition A.

The spliced breaking strength of the rope (with two eye splices) was determined (after three times applying a pre-load of 100 kN) to be about 298 kN. The rope tenacity is thus about 1.35 N/tex (strength efficiency about 40%).

The resistance to cyclic bending (bending fatigue life) of the rope was tested with a test apparatus and test specimen similar to those described in US 2004/0069132 A1. In this test a rope sample having eye splices at both ends is periodically moved over a sheave under tension, such that part of the rope is bent twice every cycle. The applied tension was 114 kN, with a cycling period of 6.14 seconds. The test was performed under ambient conditions, with water being sprayed onto the rope at the entrance/exit points of the rope on the sheave. The sheave was provided with a groove with a flat bottom of 9.6 mm width and corners rounded with a radius of 8.4 mm. The effective diameter of the sheave was 400 mm; that is the distance from neutral axis to neutral axis for a rope with an equivalent diameter of 20 mm on the sheave.

The rope had not failed after 30.000 cycles; and showed only minor damage on its surface Comparative Experiments A-E Various braided ropes were made from Dyneema® SK75 yarns, all having a titer (and equivalent diameter) similar to the rope of Example 1 (that is about 222 g/m), but of different constructions. A further variable was the type of coating applied to the rope.

All ropes were subjected to the same cyclic bending test, but in these cases a sheave was used with a rounded groove (of dimensions about 10% larger than the ropes; effective diameter 400 mm).

The results summarized in Table 1 clearly demonstrate that the rope of Example 1 shows superior resistance to cyclic bending over a sheave.

TABLE 1

| experiment | braid construction | type of coating | spliced breaking strength (kN) | number of cycles-to-failure |
|---|---|---|---|---|
| example 1 | 5 × 12 | A | 300 | >30000 |
| comp. exp. A | 12 × 1 | none | 360 | 4000 |
| comp. exp. B | 12 × 1 | B | 360 | 8000 |
| comp. exp. C | 12 × 1 | C | 360 | 8000 |

TABLE 1-continued

| experiment | braid construction | type of coating | spliced breaking strength (kN) | number of cycles-to-failure |
|---|---|---|---|---|
| comp. exp. D | 12 × 12 | C | 300 | 8000 |
| comp. exp. E | 12 × 1 | A | 360 | 19000 |

The invention claimed is:

1. Braided rope for bend-over-sheave applications consisting essentially of soutache braided primary strands, the amount of the strands being equal to n, the strands being made of polymeric filaments, the filaments being high-strength filaments having a tenacity of at least 1.5 N/tex, wherein the rope has an oblong cross-section with aspect ratio in the range 1.2-4.0, and wherein the rope has an equivalent diameter of at least 20 mm.

2. Braided rope according to claim 1, wherein the cross-section has an aspect ratio of about 1.3-3.0.

3. Braided rope according to claim 1, wherein the number of primary strands n is 3, 5, 7 or 9.

4. Braided rope according to claim 1, wherein n is 5 or 7.

5. Braided rope according to claim 1, wherein the rope has an equivalent diameter of at least 30 mm.

6. Braided rope according to claim 1, wherein the rope further comprises a coating.

7. Braided rope according to claim 1, wherein the rope contains filaments made from polypropylenes, polyesters or polyamides.

8. A load-bearing member in bend-over-sheave applications which comprises a braided rope as in claim 1.

9. System comprising a rope according to claim 1 and at least one sheave.

10. Method for making a rope according to claim 1, comprising a step of braiding n primary strands from n carriers using two counter-rotating horngears/horndogs each having n notches for transferring the carriers in a single figure eight track, with n being an odd integer of 3 or more.

11. Braided rope according to claim 1, wherein the filaments are high-modulus filaments having a tensile modulus of at least 50 N/tex.

* * * * *